United States Patent [19]

Mazzarella et al.

[11] Patent Number: 4,747,910

[45] Date of Patent: May 31, 1988

[54] STORAGE STABLE PAPER SIZE COMPOSITION CONTAINING ETHOXYLATED LANOLIN

[75] Inventors: Emil D. Mazzarella, Mountainside; Walter Maliczyszyn, Somerville; Jeffrey Atkinson, Neshanic Station, all of N.J.

[73] Assignee: National Starch and Chemical Corporation, Bridgewater, N.J.

[21] Appl. No.: 98,118

[22] Filed: Sep. 18, 1987

Related U.S. Application Data

[60] Division of Ser. No. 049,033, Apr. 27, 1987, Pat. No. 4,711,671, which is a continuation of Ser. No. 783,904, Oct. 3, 1985, abandoned.

[51] Int. Cl.[4] ..... D21H 3/08

[52] U.S. Cl. ..... 162/158; 162/179

[58] Field of Search ..... 106/243; 162/158, 179, 162/183

[56] References Cited

U.S. PATENT DOCUMENTS

| | | | |
|---|---|---|---|
| Re. 29,960 | 4/1979 | Mazzarella et al. | 162/158 |
| 3,102,064 | 8/1963 | Wurzburg et al. | 162/158 |
| 3,821,069 | 6/1974 | Wurzburg | 162/158 |
| 3,968,005 | 7/1976 | Wurzburg | 162/158 |
| 4,486,405 | 12/1984 | Klein | 424/59 |
| 4,529,447 | 7/1985 | Okada et al. | 106/287.24 |
| 4,544,414 | 10/1985 | Kawatani et al. | 106/287.24 |
| 4,545,856 | 10/1985 | Sweeney | 162/158 |
| 4,606,773 | 8/1986 | Novak | 106/213 |
| 4,666,523 | 5/1987 | Yokota et al. | 106/213 |

OTHER PUBLICATIONS

Prevention of Cracks of Paperboards, Kawano, Chem. Abst. 92:2466OR.

*Primary Examiner*—Peter Chin

*Attorney, Agent, or Firm*—Ellen T. Dec; Edwin M. Szala

[57] ABSTRACT

A shelf stable paper size is prepared from a mixture of a substituted cyclic dicarboxylic acid anhydride and an ethoxylated lanolin.

13 Claims, No Drawings

STORAGE STABLE PAPER SIZE COMPOSITION CONTAINING ETHOXYLATED LANOLIN

This application is a division of application Ser. No. 049,033, filed Apr. 27, 1987 now U.S. Pat. No. 4,711,671 which is a continuation of application Ser. No. 783,904 fied Oct. 3, 1985 now abandoned.

BACKGROUND OF THE INVENTION

This invention relates to a self-emulsifiable paper size composition characterized by improved shelf life and to a method for sizing paper and paperboard therewith. More particularly, the invention relates to a self-emulsifiable paper size composition comprising a mixture of a hydrophobic substituted cyclic dicarboxylic acid anhydride and an ethoxylated lanolin.

Paper and paperboard are often sized with various hydrophobic materials including, for example, rosin, wax emulsions, mixtures of rosin waxes, ketene dimers, isocyanate derivatives, fatty acid complexes, fluorocarbons, certain styrene-maleic anhydride copolymers, as well as the substituted cyclic dicarboxylic acid anhydrides more particularly described hereinafter. These sizes may be introduced during the actual paper making operation wherein the process is known as internal or engine sizing, or they may be applied to the surface of the finished web or sheet in which case the process is known as external or surface sizing.

In order to obtain good sizing with any of these sizing compounds, it is desirable that they be uniformly dispersed throughout the fiber slurry in a small particle size. It was general practice therefore, to add the sizes in the form of an aqueous emulsion prepared with the aid of emulsifying agents including, for example, cationic or ordinary starches, carboxymethyl cellulose, natural gums, gelatin, cationic polymers or polyvinyl alcohol, all of which act as protective colloids. The use of such emulsifying agents with or without added surfactants did, however, suffer from several inherent deficiencies in commercial practice. A primary deficiency concerned the necessity of utilizing relatively complex, expensive and heavy equipment capable of exerting high homogenizing shear and/or pressures, together with rigid procedures regarding emulsifying proportions and temperatures, etc., for producing a satisfactory stable emulsion of the particular size. Additionally, the use of many surfactants in conjunction with protective colloids was found to create operational problems in the paper making process such as severe foaming of the stock and/or loss in sizing.

With particular reference to the procedures of the prior art which utilized substituted cyclic dicarboxylic acid anhydrides as sizing agents, it was necessary in commercial practice to pre-emulsify with cationic starch and/or other hydrocolloids using relatively rigid procedures with elevated temperatures to cook the starch or hydrocolloids and high shearing and/or high pressure homogenizing equipment. Unless these complicated procedures were carefully followed, difficulties such as deposition in the paper system, quality control problems and generally unsatisfactory performance were often encountered.

Many of these problems were overcome in U.S. Reissue Pat. No. 29,960 which disclosed the use of a size mixture of these cyclic dicarboxylic acid anhydrides and specific polyoxyalkylene alkyl or alkyl-aryl ethers or their corresponding mono- or di-esters, which mixture was easily emulsifiable with water in the absence of high shearing forces and under normal pressure by merely stirring, passing through a mixing valve or common aspirator or by the usual agitation present in a stock preparation system. While satisfactory sizing properties for commercial uses were achieved with this method, the shelf stability of the mixture was poor and it was necessary to use the size mixture immediately after preparation thereof. The two components were therefore supplied separately to the paper manufacturer who continued the separate storage of the components until their use was required.

It would be desirable to be able to prepare a size in the form of a shelf stable mixture which could be stored in warehouses for periods of six months to a year, which would be self-emulsifiable and would exhibit excellent sizing properties.

SUMMARY OF THE INVENTION

We have found that a storage stable self-emulsifiable paper size may be prepared from a mixture of 80–99 parts by weight of at least one substituted cyclic dicarboxylic acid anhydride containing hydrophobic substitution and 1–20 parts by weight of ethoxylated lanolin. The mixture is storage stable for extended periods of time, i.e., for at least six months of natural aging, and exhibits excellent sizing properties when emulsified prior to addition to the paper making stock or when added directly to the system and emulsified in-situ.

DETAILED DESCRIPTION OF THE PREFERRED EMBODIMENTS

The sizing compounds contemplated for use herein are the cyclic dicarboxylic acid anhydrides containing hydrophobic substitution. Those substituted cyclic dicarboxylic acid anhydrides most commonly employed as paper sizes are represented by the following formula:

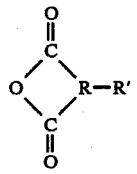

wherein R represents a dimethylene or trimethylene radical and wherein R′ is a hydrophobic group containing more than 4 carbon atoms which may be selected from the class consisting of alkyl, alkenyl, aralkyl or aralkenyl groups. Sizing compounds in which R′ contains more than twelve carbon atoms are preferred.

Representative of those cyclic dicarboxylic acid anhydrides which are broadly included within the above formula are sizing agents exemplified in U.S. Pat. Nos. 3,102,064; 3,821,069, and 3,968,005 as well as by Japanese Pat. Nos. 95,923 and Sho-59-144697.

Thus, the substituted cyclic dicarboxylic acid anhydrides may be the substituted succinic and glutaric acid anhydrides of the above described formula including, for example, iso-octadecenyl succinic acid anhydride, n- or iso-hexadecenyl succinic acid anhydride, dodecenyl succinic acid anhydride, dodecyl succinic acid anhydride, decenyl succinic acid anhydride, octenyl succinic acid anhydride, triisobutenyl succinic acid anhydride, etc.

The sizing agents may also be those of the above described formula which are prepared employing an internal olefin corresponding to the following general structure:

$$R_x—CH_2—CH=CH—CH_2—R_y$$

wherein $R_x$ is an alkyl radical containing at least four carbon atoms and $R_y$ is an alkyl radical containing at least four carbon atoms and which correspond to the more specific formula:

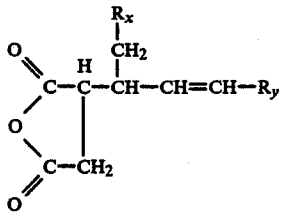

wherein $R_x$ is an alkyl radical containing at least 4 carbon atoms and $R_y$ is an alkyl radical containing at least 4 carbon atoms, and $R_x$ and $R_y$ are interchangeable. Specific examples of the latter sizing compounds include (1-octyl-2-decenyl)succinic acid anhydride and (1-hexyl-2-octenyl)succinic acid anhydride.

The sizing agents may also be prepared employing a vinylidene olefin corresponding to the following general structure

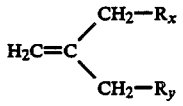

wherein $R_x$ and $R_y$ are alkyl radicals containing at least 4 carbon atoms in each radical. These compounds correspond to the specific formula:

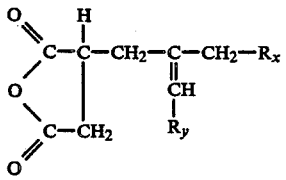

wherein $R_x$ is an alkyl radical containing at least 4 carbon atoms and $R_y$ is an alkyl radical containing at least 4 carbon atoms and $R_x$ and $R_y$ are interchangeable and are represented by 2-n-hexyl-1-octene, 2-n-octyl-1-dodecene, 2-n-octyl-1-decene, 2-n-dodecyl-1-octene, 2-n-octyl-1-octene, 2-n-octyl-1-nonene, 2-n-hexyl-decene and 2-n-heptyl-1-octene.

The sizing agents may also include those as described above prepared employing an olefin having an alkyl branch on one of the unsaturated carbon atoms or on the carbon atoms contiguous to the unsaturated carbon atoms. Representative of the latter olefins are n-octene-1; n-dodecene-1; n-octadecene-9; n-hexene-1; 7,8-dimethyl tetradecene-6; 2,2,4,6,6,8,8-heptamethylnone-4; 2,2,4,6,6,8,8-heptamethylnone-3; 2,4,9,11-tetramethyl-5-ethyldodecene-5; 6,7-dimethyldodecene-6; 5-ethyl-6-methylundecene-5; 5,6-diethyldecene-5; 8-methyltridecene-6; 5-ethyldodecene-6; and 6,7-dimethyldodecene-4.

The exthoxylated lanolins used herein includes any containing of at least about 15 moles ethylene oxide per mole lanolin. Preferred are those containing 25 to 80 moles ethylene oxide. The lanolin base may be hydrogenated or non-hydrogenated. The alkoxylation of such lanolins with ethylene oxide is well known in the art and the materials useful herein are not limited by their method of preparation. Ethoxylated lanolins containing up to about 80 moles ethylene oxide are available commercially. It is contemplated that the alkoxylation may also be performed using similar levels of propylene oxide however, these adducts are not as readily available and are more expensive.

In accordance with the method of this invention, the size mixture is formed by mixing 80 to 99 parts by weight of the aforementioned substituted cyclic dicarboxylic acid anhydride with 1 to 20 parts, preferably less than 10 parts, of the ethoxylated lanolin. The use of the latter component in excess of about 20 parts becomes uneconomical in terms of cost and may be detrimental in terms of the papermaking operation. The use of the lower levels of the ethoxylated lanolin may require greater degrees of emulsification as with a turbine or the addition of emulsifying agents.

It is to be recognized that mixtures of various combinations of substituted cyclic dicarboxylic acid anhydrides and/or lanolins of varying levels of ethoxylation may be employed in preparing a particular size mixture, as long as they fall within the scope of this invention.

The mixture of the appropriate amount of the substituted cyclic dicarboxylic acid and the ethoxylated lanolin may be prepared and held in this form for an extended period of time. Testing results run under accelerated aging conditions indicate, to date, the mixture is still stable and effective as a sizing agent after six months at 50° C. When use of the mixture is required, it may be readily emulsified either by pre-emulsifying with water before addition to the paper stock or it may be emulsified in situ at any point in the manufacturing operation where adequate agitation is present.

If pre-emulsification of the size mixture is desired, it may be readily accomplished by adding the sizing components to water in sufficient quantity so as to yield an emulsion containing the substituted cyclic dicarboxylic acid anhydride in a concentration of from about 0.1 to 20% by weight. The aqueous mixture is thereafter sufficiently emulsified merely by stirring with moderate speed agitation or by passing it through a mixing valve, aspirator or orifice so that the average particle size of the resultant emulsion will be less than about 3 microns. It is to be noted in preparing the emulsion that it is also possible to add the components of the size mixture to the water separately, and that the emulsion may be prepared using continuous or batch methods.

Emulsification of the mixture readily occurs at ambient temperatures. Thus, the emulsification will occur directly in cold water and heating of the water prior to addition of the sizing mixture is unnecessary.

As to actual use, no further dilution of the emulsion is generally necessary. The thus-prepared emulsion is simply added to the wet end of the paper making machine or to the stock preparation system so as to provide a concentration of the substituted cyclic dicarboxylic acid anhydride of from about 0.01 to about 2.0% based on dry fiber eight. Within the mentioned range, the precise amount of size which is to be used will depend for the most part upon the type of pulp which is being treated, the specific operating conditions, as well as the particular end use for which the paper product is destined. For example, paper which will require good water resistance or ink holdout will necessitate the use of a higher concentration of size than paper which will be used in applications where these properties are not critical.

Alternatively, the size emulsion may be sprayed onto the surface of the formed web at any point prior to the drying step in the concentrations as prepared so as to provide the required size concentration.

The ingredients of the size mixture may also be premixed without water and added to the paper making stock system causing the substituted cyclic dicarboxylic acid anhydride to emulsify in situ in the stock preparation system without the need for prior emulsification in water. As in the case in which the size is emulsified prior to use, the amount of size employed will vary depending on conditions, however, it will generally be within the range of about 0.01 to 2.0% substituted cyclic dicarboxylic acid anhydride based on dry fiber weight.

As is conventional in synthetic sizing operations, the size mixtures are used in conjunction with a material which is either cationic or is capable of ionizing or dissociating in such a manner as to produce one or more cations or other positively charged moieties. Among the materials which may be employed as cationic agents are long chain fatty amines, amine-containing synthetic polymers (primary, secondary tertiary or quaternary amine), substituted polyacrylamide, animal glue, cationic thermosetting resins and polyamide-epichlorohydrin polymers. Of particular use are various cationic starch derivatives including primary, secondary, tertiary or quarternary amine starch derivatives and other cationic nitrogen substituted starch derivatives as well as cationic sulfonium and phosphonium starch derivatives. Such derivatives may be prepared from all types of starches including corn, tapioca, potato, waxy maize, wheat and rice. Moreover, they may be in their original granule form or they may be converted to pregelatinized, cold water soluble products. Amphoteric natural and synthetic polymers containing both anionic and cationic groups may also be used effectively to deposit and retain the sizing agent on the fiber.

Any of the above noted cationic retention agents may be added to the stock, i.e. the pulp slurry, either prior to, along with or after the addition of the size mixture or size emulsion in conventional amounts of at least about 0.01%, preferably 0.025 to 3.0%, based on dry fiber weight. While amounts in excess of about 3% may be used, the benefits of using increased amounts of retention aid for sizing purposes are usually not economically justified.

The size mixtures are not limited to any particular pH range and may be used in the treatment of neutral and alkaline pulp, as well as acidic pulp. The size mixtures may thus be used in combination with alum, which is very commonly used in making paper, as well as other acid materials. Conversely, they may also be used with calcium carbonate or other alkaline materials in the stock.

Subsequent to the addition of the size emulsion and retention aid, the web is formed and dried on the paper making machine in the usual manner. In actual paper machine operations, full sizing is generally achieved immediately off the paper machine. Because of limited drying in laboratory procedures however, further improvements in the water resistance of the paper prepared with the size mixtures of this invention may be obtained by curing the resulting webs, sheets, or molded products. This post-curing process generally involves heating the paper at temperatures in the range of from 80° to 150° C. for a period of from 1 to 60 minutes.

The size mixtures of the present invention may be successfully utilized for the sizing of paper and paperboard prepared from all types of both cellulosic and combinations of cellulosic with non-cellulosic fiber. Also included are sheet- like masses and molded products prepared from combinations of cellulosic and non-cellulosic materials derived from synthetics such as polyamide, polyester and polyacrylic resin fibers as well as from mineral fibers such as asbestos and glass. The hardwood or softwood cellulosic fibers which may be used include bleached and unbleached sulfate (Kraft) bleached and unbleached sulfite, bleached and unbleached soda, neutral sulfite semi-chemical, groundwood, chemigroundwood, and any combination of these fibers. In addition, synthetic cellulosic fibers of the viscose rayon or regenerated cellulose type can also be used, as well as recycled waste papers from various sources.

All types of pigments and fillers may be added in the usual manner to the paper product which is to be sized. Such materials include clay, talc, titanium dioxide, calcium carbonate, calcium sulfate and diatomaceous earths. Stock additives, such as defoamers, pitch dispersants, slimicides, etc. as well as other sizing compounds, can also be used with the size mixtures described herein.

As noted above, the size mixtures described herein exhibit extended shelf life, and, when emulsified and used in the paper stock system, yield paper products having superior sizing properties, even after these extended storage periods. The following examples will further illustrate the emodiments of the present invention. In these examples, all parts given are by weight unless otherwise specified.

EXAMPLE I

This example illustrates the use of a size mixture representative of the size mixtures of this invention utilized in the form of an aqueous emulsion. This emulsion is compared, in terms of particle size and water resistance of the resulting sized paper, with a conventional emulsion made with a mixture of substituted cyclic dicarboxylic acid anhydride and a polyoxyalkylene alkyl-aryl ether.

A size mixture was prepared by combining 7 parts of hydrogenated ethoxylated lanolin containing 20 moles ethylene oxide per mole lanolin and 93 parts of alkenyl substituted succinic acid anhydride wherein the alkenyl groups contained 15 to 20 carbon atoms (hereinafter referred to as ASA). The mixture was aged for varying lengths of time at 50° C. When emulsification was desired, the emulsion was formed by agitating 2 parts of the mixture with 98 parts of a cooked aqueous dispersion of cationic corn starch (containing sufficient starch to provide 0.05% based on dry fiber weight) using a propeller-type agitator at moderate speed (500 rpm) for 10 seconds (Emulsion No. 1). A control was prepared in accordance with U.S. Reissue Pat. No. 29,960 using 93 parts of the same ASA and 7 parts of polyoxyalkylene alkyl-aryl ether wherein the alkyl group contained 9 carbon atoms, the aryl radical was phenol, and the polyoxyalkylene moiety was formed with 9.5 moles of ethylene oxide.

Calculated amounts of the emulsions prepared as described above were added to aqueous slurries of bleached sulfate pulp having a Williams freeness of 400, a consistency of 0.5% and a pH of about 7.6, so as to yield a concentration of ASA on dry fiber weight of 0.25%. Then 0.5% alum based on dry fiber weight, was added to the pulp slurry before addition of the sizing emulsions. Sheets were formed in accordance with TAPPI standards, dryed on a rotary print drier (surface temperature approx. 90° C.) then cured for 1 hour at 105° C. and conditioned overnight at 72° F. and 50% R.H. before testing. The basis weight of these sheets was 55 lbs./ream (24×36 inch—500 sheets).

The Hercules Size Performance Test (HST) was employed to compare the ink resistance of the sheets prepared. The test comprises applying an amount of acid ink (pH 2.3) to the upper paper surface. With the use of a photoelectric cell, the underside of the paper is monitored for reflectance. The time it takes for the ink to cause a decrease in reflectance from 100% to 80% is the paper's HST time. The HST of the paper is a measure of the sizing performance of a given size. The longer the HST time, the better the size is.

The average particle size (APS) was measured by optical microscopic observation using a calibrated graduated eye piece under 400–600× magnification.

Table I presents the average particle size (APS in microns) and internal sizing data (HST in seconds) for the above-described emulsions.

TABLE I

| | Fresh | | Accelerated Aging | | | |
|---|---|---|---|---|---|---|
| | | | 1 Month | | 6 Months | |
| Emulsion | HST | APS | HST | APS | HST | APS |
| Control | 248 | <1 u | 0 | 20 u | 0 | 50 u |
| 1 | 266 | <1 u | 275 | <1 u | 328 | 1–2 u |

Both the emulsion quality (shown by particle size) and sizing performance (shown by the HST results) indicate that there is no loss in performance with the use of the size employing the ethoxylated lanolin, wheras after only one month accelerated aging, the control made a poor emulsion with no sizing.

EXAMPLE II

Mixtures of ASA and ethoxylated lanolin were prepared as in Example I with hydrogenated ethoxylated lanolin of varying levels of ethylene oxide (E.O.) substitution. These mixtures were evaluated (fresh) for emulsification and sizing performance. Fifteen moles of ethylene oxide provided minimally acceptable performance. With 27, 40, and 75 moles of ethylene oxide excellent results were obtained.

TABLE II

| | Fresh | | 3 Months | |
|---|---|---|---|---|
| Moles of E.O. | APS | HST | APS | HST |
| 10 | >25 u | * | >25 | * |
| 15 | <5 u | 188 | 7 | 193 |
| 27 | <2 u | 247 | 2 | 237 |
| 40 | <1 u | 233 | 1 | 243 |
| 75 | >1 u | 256 | 1 | 240 |

*Emulsion was too poor to evaluate.

EXAMPLE III

This example shows a comparison of direct (un-emulsified) addition and pre-emulsified addition to the stock with both freshly made and three month (accelerated) aged sizing mixtures. The pre-emulsified product was prepared using the procedure of Emulsion 1 in Example I. With direct addition of the ASA/hydrogenated ethoxylated lanolin mixtures the emulsification occurs in-situ due to the shear inherent to the system. In this case, the mixture of Example I was added directly to a slurry of bleached sulfate pulp at 1.5% consistency in a laboratory Valley beater and beaten very lightly for a few minutes. The pulp was then diluted to 0.5% consitency, and 0.4% on dry fiber weight of the cationic starch described in Example I was added separately to the slurry to act as a retention aid during sheet formation. Sheets were then formed, conditioned and tested in the HST test as described In Example I.

TABLE III

| | Pre-Emulsified Addition | | Direct Pulp Addition | |
|---|---|---|---|---|
| Emulsion | HST | APS | HST | APS |
| Freshly made control | 256 | <1 u | 248 | <1 u |
| One month aged control | 0 | 20 u | 0 | 30 u |
| Freshly made mixture | 268 | <1 u | 252 | <1 u |
| One month aged mixture | 273 | <1 u | 261 | <1 u |

The results show that the ethoxylated lanolin/ASA mixtures provided better sizing and equivalent particle size compared to the control as described in Example I by both pre-emulsification and direct addition and that one month accelerated aging had no adverse effect on the performance of the mixtures.

EXAMPLE IV

In this example the hydrogenated ethoxylated lanolin was evaluated as an emulsifier for four different cyclical dicarboxylic acid anhydrides prepared as in Example I using 7 parts of the ethoxylated lanolin and 93 parts of the anhydride. The results show that good performance could be achieved with all four anhydride structures.

TABLE IV

| | Fresh | |
|---|---|---|
| Emulsions | HST | APS |
| Alkenyl succinic acid anhydride | 278 | <1 u |
| Iso-octadecenyl succinic acid anhydride | 164 | <1 u |
| Hexapropylene succinic acid anhydride | 267 | 2 u |
| 1-octyl, 2-decenyl succinic acid anhydride | 319 | <1 u |

EXAMPLE V

In this example the mixture of hydrogenated ethoxylated lanolin, prepared as in Example I, was compared to three other classes of emulsifiers described in U.S. Reissue Pat. No. 29,960. Even though these emulsifiers showed improved stability over the polyoxyalkylene alkyl aryl ether emulsifiers, used as a control in Example I, the degree of stability does not approach the level of that achieved by use of ethoxylated lanolin as described herein.

TABLE V

| | Freshly Made | | One Month Aged | |
|---|---|---|---|---|
| Emulsions | HST | APS | HST | APS |
| 1 | 264 | <1 u | * | 20 u |
| 2 | 267 | <1 u | * | 20 u |
| 3 | 176 | 3 u | 18 | 8 u |
| 4 | 197 | 2 u | 27 | 8 u |

TABLE V-continued

| Emulsions | Freshly Made HST | Freshly Made APS | One Month Aged HST | One Month Aged APS |
|---|---|---|---|---|
| 5 | 271 | <1 u | 243 | <1 u |

1. Polyoxyalkylene alkyl-aryl ether (as in the control of Example I)
2. Polyoxyalkylene alkyl ether wherein the alkyl group contains 12 carbon atoms and the polyoxyalkylene moiety was formed with 6 moles of ethylene oxide.
3. Polyoxyethylene monooleate ester wherein the molecular weight of the polyoxyethylene moiety was 400.
4. Polyoxyethylene dilaurate ester wherein the molecular weight of the polyoxyethylene moiety was 600.
5. Hydrogenated ethoxylated lanolin.
*Emulsions too poor to evaluate.

These results show that upon aging only the ethoxylated lanolin retains 100% of its original performance. When freshly made the ethoxylated lanolin exhibited at least equivalent performance to all of the other emulsifiers.

EXAMPLE VI

In this example the level of ethoxylated lanolin varied from 1–20%, as shown in the table to ascertain the effect of high levels in the sizing mixture. The mixtures and emulsions were prepared in accordance with Example I but varying the relative amounts of ethoxylated lanolin and ASA.

TABLE VI

| Emulsion | HST | APS |
|---|---|---|
| Control | 210 | 1 u |
| 1% ethoxylated lanolin | 230 | >2 u |
| 5% ethoxylated lanolin | 228 | <1 u |
| 10% ethoxylated lanolin | 177 | <1 u |
| 15% ethoxylated lanolin | 145 | <1 u |
| 20% ethoxylated lanolin | 140 | <1 u |

This data shows that levels as low as 1% work effectively, and that 20%, while acceptable, causes reduced sizing results.

EXAMPLE VII

This example shows that an anhydrous non-hydrogenated ethoxylated lanolin works as well as the hydrogenated ethoxylated lanolin when the sizing mixture is freshly made and after three and one-half months accelerated aging. Mixtures and emulsions were prepared and evaluated as in Example I.

TABLE VII

| Emulsion | Freshly Made HST | Freshly Made APS | 3.5 Months Aged HST | 3.5 Months Aged APS |
|---|---|---|---|---|
| Non-hydrogenated lanolin | 285 | >1 u | 306 | >1 u |
| Control (of Ex. I) | 294 | <1 u | 0 | 20 u |

In summary, the invention is seen to provide the practitioner with a size mixture useful in the manufacture of sized paper products. The size mixture is shelf stable over an extended period of time, and is easily emulsified when desired for use under a wide variety of paper making conditions to provide superior sized paper products. Variations may be made in proportions, procedures and materials without departing from the scope of this invention.

We claim:

1. A method for sizing paper products comprising the steps of (a) providing a paper stock system;

(b) forming, in the absence of high shearing forces and under normal pressures, a sizing emulsion comprising from 80 to 99 parts of a substituted cyclic dicarboxylic acid anhydride containing hydrophobic substitution; from 1 to 20 parts of an ethoxylated lanolin containing at least 15 moles ethylene oxide per mole lanolin; and water;

(c) forming a web from the paper stock system;

(d) dispersing said emulsion within the paper stock either before or after formation of said web but prior to passing said web through the drying stage of the paper making operation in an amount sufficient to provide a concentration of the substituted cyclic dicarboxylic acid anhydride of from 0.01 to 2.0%, based on dry fiber weight.

2. The method of claim 1, wherein the sizing emulsion is formed in situ within the paper stock system.

3. The method of claim 1, wherein the sizing emulsion is formed prior to introduction into the paper stock system.

4. The method of claim 3, wherein the size mixture is emulsified with water in a sufficient quantity to yield an emulsion containing the substituted cyclic dicarboxylic acid anhydride in a concentration of from 0.1 to 20%, by weight of the total emulsion, prior to addition to the paper stock system.

5. The method of claim 4 wherein the size mixture is emulsified in an aqueous dispersion of a cationic or amphoteric retention agent.

6. The method of claim 3, wherein the size mixture in the form of an aqueous emulsion is sprayed onto the formed web prior to the drying operation.

7. The method of claim 1, wherein there is dispersed within the paper stock prior to the conversion of the paper stock into a dry web, at least 0.01% based on dry fiber weight, of a cationic retention agent.

8. The method of claim 1 wherein the cyclic dicarboxylic acid anhydride is represented by the formula:

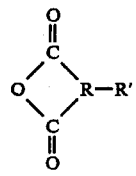

wherein R represents a dimethylene or trimethylene radical and wherein R′ is a hydrophobic group containing more than 4 carbon atoms which may be selected from the class consisting of alkyl, alkenyl, aralkyl, or aralkenyl groups.

9. The method of claim 8 wherein the cyclic dicarboxylic acid anhydride is selected from the group consisting of:

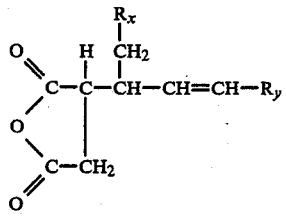

a wherein $R_x$ is an alkyl radical containing at least 4 carbon atoms and $R_y$ is an alkyl radical containing at least 4 carbon atoms, and $R_x$ and $R_y$ are interchangeable;

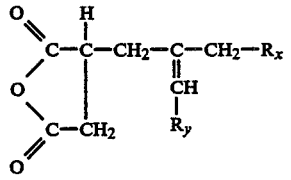

wherein $R_x$ is an alkyl radical containing at least 4 carbon atoms and $R_y$ is an alkyl radical containing at least 4 carbon atoms and $R_x$ and $R_y$ are interchangeable.

10. The method of claim 1 wherein the ethoxylated lanolin contains 25 to 80 moles ethylene oxide per mole lanolin.

11. The method of claim 1 wherein the ethoxylated lanolin is present in an amount less than 10 parts by weight of the mixture.

12. Paper or paperboard prepared by the method of claim 1.

13. Paper or paperboard prepared by the method of claim 2.

* * * * *